US006543059B2

(12) United States Patent
Szczesuil et al.

(10) Patent No.: US 6,543,059 B2
(45) Date of Patent: Apr. 8, 2003

(54) PROTECTIVE GLOVE AND METHOD FOR MAKING SAME

(75) Inventors: Steve Szczesuil, Framingham, MA (US); Debra McLean, Whitinsville, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/879,869

(22) Filed: Jun. 8, 2001

(65) Prior Publication Data

US 2002/0184697 A1 Dec. 12, 2002

(51) Int. Cl.[7] ..... A41D 19/00
(52) U.S. Cl. ..... 2/161.6; 2/16; 2/167

(58) Field of Search ..... 2/16, 20, 161.6, 2/161.7, 161.8, 164, 167, 169; 427/2.1, 230; 442/101, 148, 402, 134

(56) References Cited

U.S. PATENT DOCUMENTS 4,589,940 A * 5/1986 Johnson ..... 156/78
5,740,551 A * 4/1998 Walker ..... 2/16

* cited by examiner

*Primary Examiner*—John J. Calvert
*Assistant Examiner*—Katherine Moran
(74) *Attorney, Agent, or Firm*—Vincent J. Ranucci

(57) ABSTRACT

A protective glove for a human hand includes an inner glove of polyester nonwoven needlepunched material and a coating thereon. The coating is a polyurethane plastic adhesive adhered to the inner glove and penetrating an outer surface thereof to a depth short of an inner surface thereof.

6 Claims, 1 Drawing Sheet

PROTECTIVE GLOVE AND METHOD FOR MAKING SAME

STATEMENT OF GOVERNMENT INTEREST

The invention described herein may be manufactured and used by and for the Government of the United States of America for Governmental purposes without the payment of any royalties thereon.

BACKGROUND OF THE INVENTION

1. Field of the Invention

The invention relates to protective gloves for human hands and is directed more particularly to a glove providing protection against punctures, cuts and tears in the handling of barbed wire, concertina wire, razor wire, and the like, all hereinafter referred to as "barbed wire".

2. Description of the Prior Art

Current gloves for handling barbed wire and other sharp articles are made of heavy and thick materials, usually leather. The gloves are inflexible, cumbersome, cold and costly. Typically, such gloves lack durability, suffering severe degradation in short order by snagging, abrasions, cuts, tears, and punctures experienced in handling the barbed wire. Further, the gloves are outseamed, which provides a further area in which barb and razor wire can snag. The gloves absorb water and therefore become very heavy in rain and mud. They also absorb lubricants, which increases the weight of the gloves. Such thick heavy gloves cause hand fatigue during extensive continuous wear, as during an eight hour working period.

Further, current gloves in use include two layers of leather stapled together with metal staples about every ¼ inch. The staples conduct cold from external to internal portions of the glove, further diminishing the comfort level for a user in a cold environment.

The construction of the gloves in current use is expensive and the fact that the life expectancy of such gloves is quite short merely escalates the glove expense for a barbed wire handling project.

Accordingly, there is a need for a glove for handling barbed wire, and which is comfortable, light weight, flexible, durable, water repellent and less costly, but which offers protection against punctures, cuts and tears.

SUMMARY OF THE INVENTION

An object of the invention is, therefore, to provide a protective glove which provides full hand protection against puncture and cut threats from barbed wire, without the usually attendant bulk and weight.

A further object of the invention is to provide such a glove which is soft, sorptive of sweat, insulative, and which can be produced with the finger seams on the inside, or inseamed.

A still further object of the invention is to provide such a glove as is amenable to low-cost manufacture.

With the above and other objects in view, as will hereinafter appear, a feature of the invention is the provision of a protective glove for a human hand. The protective glove includes an inner glove of polyester nonwoven needlepunched material and a coating thereon. The coating is a polyurethane plastic adhesive adhered to the inner glove and penetrating an outer surface thereof to a depth short of an inner surface thereof.

In accordance with a further feature of the invention, there is provided a method for making a protective glove for a human hand. The method includes the steps of providing an inner glove of polyester nonwoven needlepunched material, coating the inner glove with a polyurethane moisture-cure adhesive heated to about 300–325° F., and curing the coating. The method provides a protective glove resistant to snags, cuts and punctures, while remaining flexible for handling barb wire, razor wire, and the like.

The above and other features of the invention, including various novel details of construction and combinations of parts and method steps, will now be more particularly described with reference to the accompanying drawings and pointed out in the claims. It will be understood that the particular device and method embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
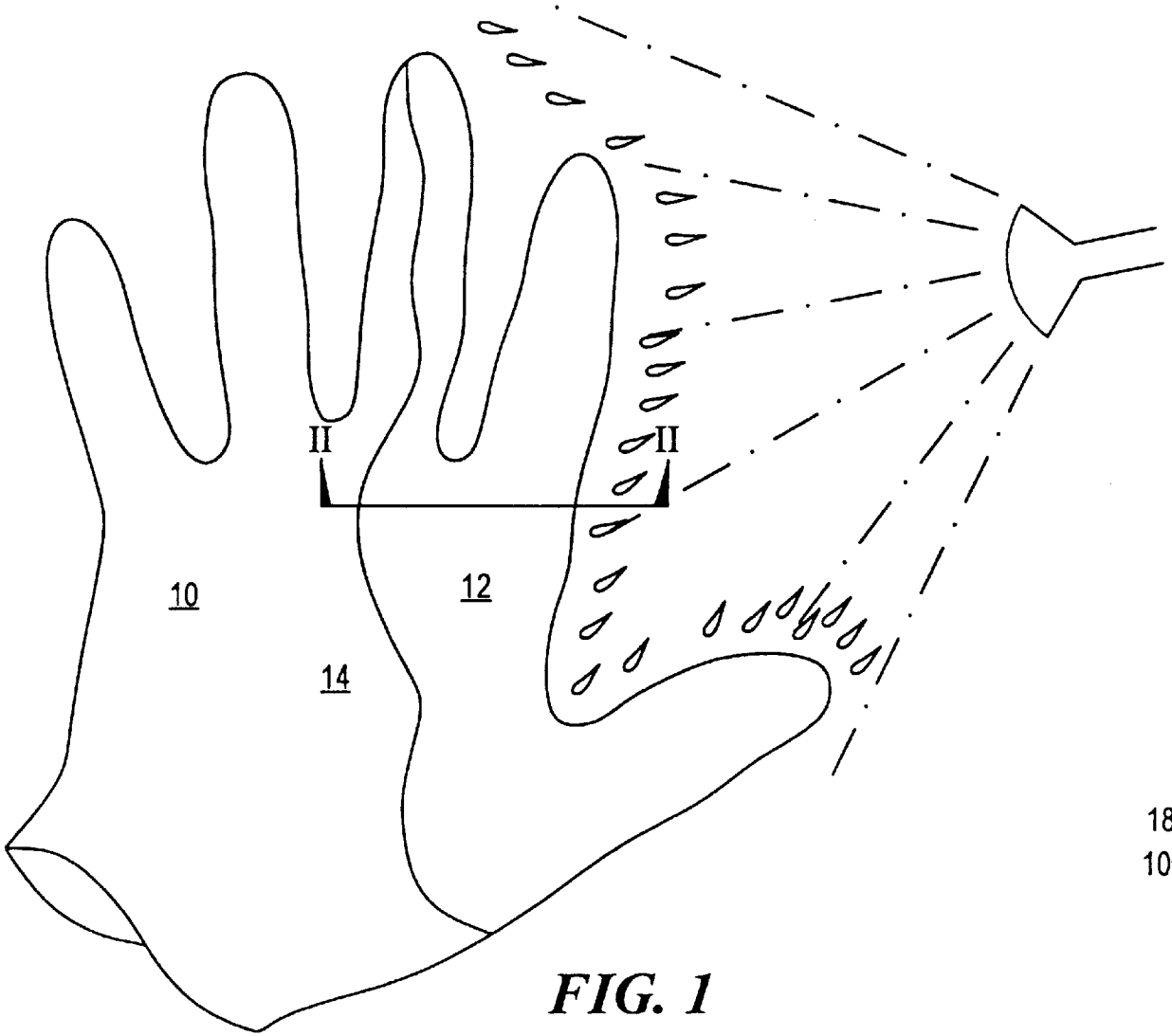
FIG. 1 is a diagrammatic illustration of one form of glove, and of steps in the making of the glove, illustrative of embodiments of the invention.

Referring to FIG. 1, it will be seen that the illustrative protective glove includes an inner glove 10 of polyester nonwoven needlepunched material, configured to conform to a human hand and provide full coverage thereof.

Figure 2:
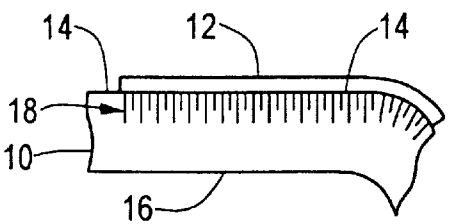
FIG. 2 is a diagrammatic sectional view taken along line II—II of FIG. 1.

A coating 12 of non-toxic liquid polyurethane plastic moisture-cure adhesive is applied to an outer surface 14 of the inner glove 10, as by dipping the inner glove in the liquid coating adhesive, or by brushing the liquid coating adhesive onto the inner glove outer surface 14, or by spraying the inner glove outer surface with the coating adhesive in liquid droplet form, or by coating a sheet of polyester material in a fabric formation with an adhesive and/or a rubberized coating and cutting and sewing the coated material in a cut and sewn seamed glove. The sprayed method is illustrated in FIG. 1, wherein a portion of the glove is shown coated for illustrative purposes. In FIG. 2 is illustrated the result of either method, the applied coating 12 being shown adheared to and penetrated into the inner material. The polyurethane plastic adhesive is heated prior to application to the inner glove, preferably to about 300–325° F.

The heated coating adheres to the outer surface 14 of the inner glove 10 and penetrates the surface 14 to a depth well short of an inner surface 16 of the inner glove. The inner glove polyester material preferably is of a weight of about 12–13 ounces per square yard, and a thickness of about 0.09–0.1 inch. The inner glove is thus soft, supple, and thermally insulative material. The coating adhesive 12 penetrates as illustrated by 18 in FIG. 2, to a depth of about 0.002–0.004 inch, and preferably about 0.002 inch.

After completion of application of the coating 12, the coating is cured until fibers of the polyester material are tied together by the adhesive coating. Curing for twenty-four hours has been found appropriate. The coating firms, stiffens, and ties together the outer surface polyester fibers of the inner glove, but does not penetrate to the inner surface 16, providing a wearer with the feel of soft polyester. Upon becoming fully cured, the coating 12 becomes snag, cut and puncture resistant. The stiffness of the completed glove is dependent upon the thickness of the coating 12. However, even with a thick coating the fingers remain agile for work with barb wire.

The inner glove 10 may be assembled by sewing together a palm piece and a back hand piece. If the inner glove is sewn, the seams preferably are inseams, to protect seam structures from being cut or torn away. Alternatively, the polyester palm piece and back hand piece may be heat bonded together, rather than sewn. By using heat bonding and the aforementioned spray application of the coating, the gloves described herein may be manufactured by a relatively simple automated fabrication process.

Thus, there is provided a protective glove which provides protection to a user against cuts and punctures while handling barbed wire, but which is not bulky or heavy, compared to cut-resistant or even ordinary cold weather gloves, and which is soft and supple inside, and is insulative against cold outside temperatures.

It is to be understood that the present invention is by no means limited to the particular construction and method steps herein disclosed and/or shown in the drawings, but also comprises any modification or equivalent within the scope of the claims. For example, it will be apparent that in manufacture of the glove the material from which the glove is made may be coated and then cut and sewn to form the glove.

What is claimed is:

1. A protective glove for a human hand, the glove comprising:

an inner glove of polyester nonwoven needlepunched material; and a coating on said inner glove, said coating adhered to an outer surface of the inner glove and penetrating the outer surface to a depth short of an inner surface of said inner glove, wherein said coating comprises a polyurethane plastic moisture-cure adhesive, said adhesive being heated to about 300–325° F. prior to application to said inner glove, and wherein said inner glove is of a weight of about 12–13 oz. per square yard.

2. The protective glove in accordance with claim 1 wherein said inner glove is of a thickness of about 0.09–0.1 inch.

3. The protective glove in accordance with claim 1 wherein said inner glove is of a thickness of about 0.09–0.1 inch.

4. The protective glove in accordance with claim 1 wherein fibers of the polyester needlepunched material are tied together by the adhesive to provide a semi-hard outer glove surface exhibiting cut resistance and puncture resistance.

5. The protective glove in accordance with claim 2 wherein said coating penetrating depth is about 0.002–0.004 inch.

6. The protective glove in accordance with claim 3 wherein said coating penetrating depth is about 0.002–0.004 inch.

* * * * *